US006874340B1

(12) United States Patent
Berman

(10) Patent No.: US 6,874,340 B1
(45) Date of Patent: Apr. 5, 2005

(54) QUICK LOCK RELEASE SYSTEM FOR PARKING METER VAULTS

(75) Inventor: Lawrence Berman, Delray Beach, FL (US)

(73) Assignee: Duncan Industries, Harrison, AR (US)

( * ) Notice: Subject to any disclaimer, the term of this patent is extended or adjusted under 35 U.S.C. 154(b) by 92 days.

(21) Appl. No.: 10/159,552

(22) Filed: May 31, 2002

(51) Int. Cl.[7] ..... B65D 55/14
(52) U.S. Cl. ..... 70/161; 70/160; 70/368; 70/465
(58) Field of Search ..... 70/DIG. 41, 159–162, 70/368, 370, 371, 465; 194/900

(56) References Cited

U.S. PATENT DOCUMENTS

RE17,936 E * 1/1931 Shinn ..... 70/368
3,199,321 A * 8/1965 Sollenberger ..... 70/1.5
3,236,076 A * 2/1966 Wellekens ..... 70/134
3,261,186 A * 7/1966 Laviana ..... 70/116
3,745,795 A * 7/1973 Sanders ..... 70/451
4,380,915 A * 4/1983 Kincaid et al. ..... 70/224
4,471,638 A * 9/1984 Scheerhorn ..... 70/368
4,484,462 A * 11/1984 Berkowitz ..... 70/368
5,038,589 A * 8/1991 Martin ..... 70/368
5,172,577 A * 12/1992 Gibson ..... 70/272
5,979,200 A * 11/1999 Cliff ..... 70/491
6,000,250 A * 12/1999 Daoud ..... 70/56
6,006,556 A * 12/1999 Daoud ..... 70/56
6,099,050 A * 8/2000 Daoud ..... 292/281
6,182,479 B1 * 2/2001 Daoud ..... 70/2

* cited by examiner

*Primary Examiner*—John B. Walsh
(74) *Attorney, Agent, or Firm*—Piper Rudnick LLP

(57) ABSTRACT

A parking meter has a vault housing and a vault door removably covering a main opening and having a back facing an interior of the housing. A lock assembly includes a lock cylinder disposed on the door and that has a body and a usually movable portion. A bolting mechanism operatively connects to the movable portion of the lock cylinder for selectively providing a locked position. A support structure is disposed on the interior side of the door and holds the bolting mechanism. A removable retainer engages the body of the lock cylinder, which is usually stationary. This results in the retainer preventing motion of the body sufficient to operate the bolting mechanism. The support structure is configured for releasably maintaining the retainer on the lock cylinder body. The vault housing defines a tool hole providing access to the interior of the housing for insertion of a disengagement tool through the tool hole. The retainer has a portion configured for connecting to the disengagement tool and is configured so that retracting the disengagement tool while connected to the retainer provides enough disengagement from the lock cylinder body to permit motion of the lock cylinder body to operate the bolting mechanism when the movable portion will not move relative to the body.

52 Claims, 9 Drawing Sheets

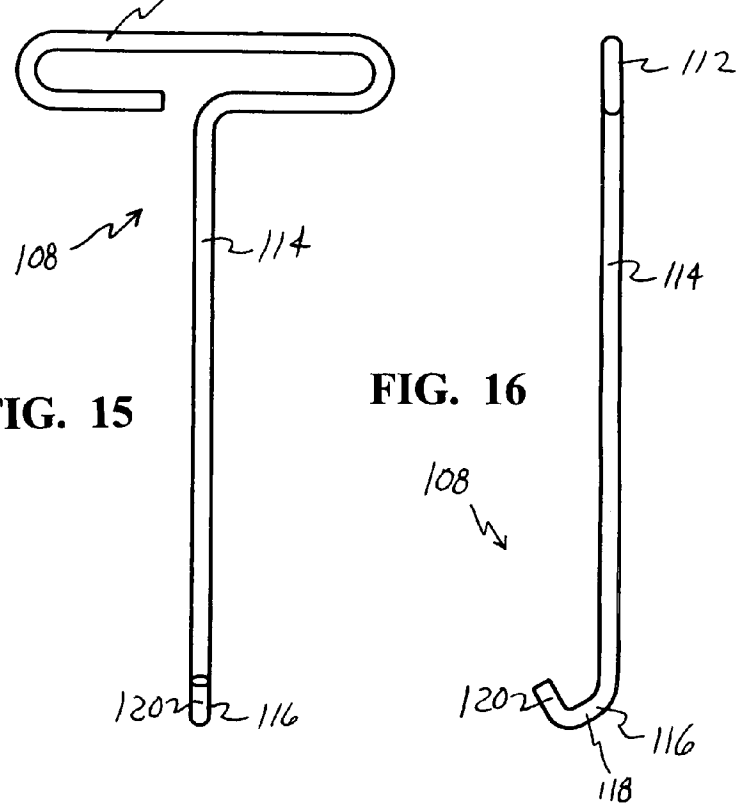
FIG. 16
FIG. 15
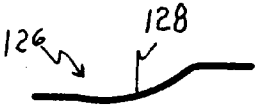
FIG. 17
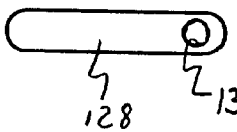
FIG. 18
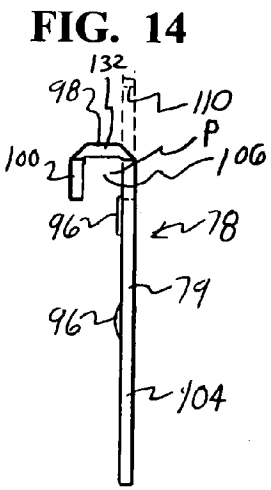
FIG. 14
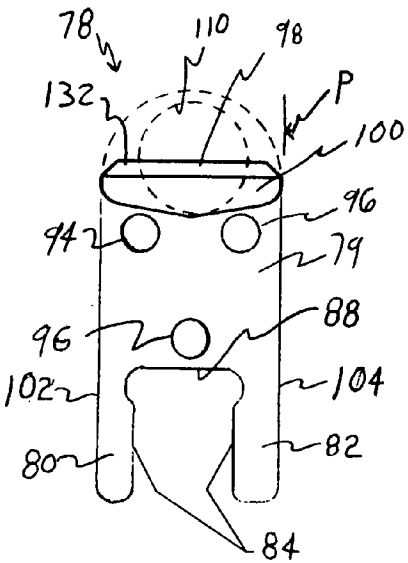
FIG. 13

QUICK LOCK RELEASE SYSTEM FOR PARKING METER VAULTS

TECHNICAL FIELD

The present invention relates generally to parking meters, and more particularly to the opening of parking meter vault doors with jammed malfunctioning locks.

BACKGROUND OF THE INVENTION

Referring to FIGS. 1–4, a conventional parking meter 200, such as Duncan Models 80, 90, 95, 2000, 90 duplex and 95 duplex, has an upper housing 202 for receiving coins, using a timer and displaying a time period based on the amount and type of coins received. The meter 200 also has a lower housing or vault 204 typically holding a coin box (not shown) for storing the coins inserted into the top housing 202. The vault 204 has an opening 206 covered by a vault door 208 that swings on brackets 210 for opening and closing the vault door. A lock cylinder 212 is positioned on a back or back side 214 of the door 208 and has a key hole 216 exposed to the exterior of the door 208 through a hole 218 in the door.

The lock cylinder 212 has a rotatable shaft 242 secured to a lock cam 220 which has two slots 222 for receiving bolt pins 224 extending from bolts 226. The bolts 226 are supported between bracket plates 228, 230. When a key (not shown) is turned in the lock cylinder 212, it turns the lock cam 220 which pushes the bolt pins 224 along slots 222. This in turn drives the bolts 226 to engage or disengage holes 232 on bolting plates 234 disposed on the vault housing 204 in order to lock or unlock the vault door 208.

As shown in FIG. 3, a retainer 236 straddles the lock cylinder 212 and clamps onto the top and sidewalls 238 of the lock cylinder to prevent rotation of the body or exterior surface 244 of the lock cylinder, as well as secure it against the door 208 both vertically and horizontally. Walls 240 of the bracket 228 abut the sides of the retainer 236 and prevent rotation of the retainer.

Frequently, the lock cylinder 212 breaks or malfunctions so that the vault door 204 cannot be opened. This occurs, for example, when the wear of the gears in the lock cylinder or a broken key piece or other foreign instrument within the keyhole jams the lock cylinder so that shaft 242 will not rotate. In this case, the vault door must be opened first to gain access to the lock cylinder 212 for replacement or repair. One way to unlock the door is to rotate the entire lock cylinder (or lock cylinder body) 212 to thereby rotate the cam 220 which in turn moves the bolts 226. This cannot be accomplished, however, as long as the retainer 236 is holding the lock cylinder 212 and prevents such rotation.

As a result, opening the broken vault door 208 is typically accomplished by drilling holes at appropriate locations on the vault door as known in the art to disengage it from the vault housing 204. Once the door 208 is open, the retainer 236 can be pulled off of the lock cylinder 212 to remove it from the door 208. This procedure not only requires repeated use of expensive and sometimes dangerous equipment (i.e. drills), but frequently damages the vault door 208, bracket plates 228, 230 and other pieces of the lock on the door. In that case, repair and replacement of these additional parts becomes necessary when, initially, only the lock cylinder was broken.

Another problem occurs once the retainer is pulled off and the lock cylinder is free to rotate and move. In that case, if the lock cam 220 moves outward (i.e. away from the vault door 208) so that it disengages from the bolt pins 224, the lock cylinder 212, along with the lock cam 220, will fall into the interior of the vault 204. It is frequently cumbersome and time consuming to retrieve the lock cylinder and cam from inside the vault.

SUMMARY OF THE INVENTION

In one aspect of the present invention, the problems mentioned above are solved by a quick lock release system for a parking meter with a tamper-resistant enclosure, such as a parking meter vault that has a vault housing and a vault door removably covering a main opening and having a back facing an interior of the housing. A lock assembly includes a lock cylinder disposed on the door and has a usually stationary body and a usually movable portion designed to move relative to the body. A bolting mechanism is operatively connected to the movable portion of the lock cylinder for selectively providing a locked position. A support structure is disposed on the back of the door and holds the bolting mechanism on the back of the door. A removable retainer engages the body of the lock cylinder for preventing motion of the body that interferes with operation of the movable portion and for preventing sufficient motion of the body to operate the bolting mechanism when the movable portion is not moving relative to the body, such as when the lock cylinder is broken or jammed.

The support structure is configured for releasably maintaining the retainer on the body and prevents motion of the retainer in a direction other than a direction defined by release of the retainer. The vault housing defines a tool hole providing access to the interior of the housing for insertion of a disengagement tool through the tool hole. The retainer has a portion configured for connecting to the disengagement tool. Thus, the retainer is configured so that retracting the disengagement tool connected to the retainer, when the movable portion will not move relative to the body, provides enough disengagement from the body to permit motion of the body to operate the bolting mechanism.

One aspect of the present invention is the lock cylinder retainer itself. The retainer includes a retainer body with a first end configured for engaging the lock cylinder for preventing movement of the lock cylinder body relative to the support structure and the door. Sides of the retainer engage the support structure to prevent movement of the retainer. An upper end of the retainer is configured for engaging a disengagement tool. Retracting the disengagement tool, once it is engaged with the retainer, disengages the retainer from the lock cylinder body to permit the lock cylinder body to move to unlock the vault door.

Another aspect of the invention, is a disengagement tool for disengaging the lock cylinder retainer from a lock cylinder on a back of a vault door of a parking meter vault. The retainer includes an elongated body with first and second ends, where the body is configured for insertion through a hole formed on a vault housing of a parking meter vault. A handle is disposed at the first end configured for inserting and retracting the body from the vault housing. A hook is formed at the second end, and is configured for engaging the retainer and maintaining the engagement while retracting the body from the vault housing.

In a further aspect of the present invention, a tamper-resistant locked enclosure has a lock assembly mounted on the door and has a first, usually stationary portion and a second portion movable relative to the first portion. Preselected movement of the second portion causes the door to be unlocked from the opening, and the preselected movement is actuated by a key applied to the lock assembly from the exterior. Preselected movement of the first portion causes the door to be unlocked from the opening. A retainer is movable between first and second positions. The retainer in the first position engages the first portion of the lock assembly to prevent the preselected movement of the first portion. When the retainer is in the second position, it permits the preselected movement of the first portion of the lock assembly.

The retainer also has a disengagement tool connection portion, while the enclosure defines a tool hole communicating the exterior to the interior so that an end of a disengagement tool can be inserted into the tool hole and connected to the disengagement tool portion of the retainer. The disengagement tool is actuable to move the retainer to the second position so as to permit the first portion of the lock assembly to be moved, thereby opening the door.

Still another aspect of the present invention is directed to a tamper-resistant enclosure and a method of unlocking such an enclosure, or more specifically, a closed parking meter vault. This includes the steps of disengaging a retainer engaged on a lock cylinder body disposed on a back of a vault door of the vault while the door is closed and locked on the vault. In addition, the method includes moving the lock cylinder body to unlock said door, said disengaging being performed without damaging said door and said vault.

These aspects of the invention permit the opening of a locked and closed vault door with a broken lock by rotating the lock cylinder on the door. This reduces damage in repairing the vault in a way that is safer to the person opening the vault.

BRIEF DESCRIPTION OF THE DRAWINGS

The above mentioned and other features of the present invention and the manner of obtaining them will be apparent, and the invention itself will be best understood by reference to the following description of the preferred embodiment of the invention in conjunction with the following drawings, in which:

FIGS. 13, 14 are respectively a front elevation view and side elevation view of the retainer for the vault door and an alternative retainer design shown in dashed line according to the present invention;

FIGS. 15, 16 are respectively a front elevation view and side elevation view of the disengagement tool according to the present invention;

FIGS. 17, 18 are respectively a top plan view and side elevation view of a holding clip according to the present invention;

DETAILED DESCRIPTION OF THE PREFERRED EMBODIMENT

Figure 2:
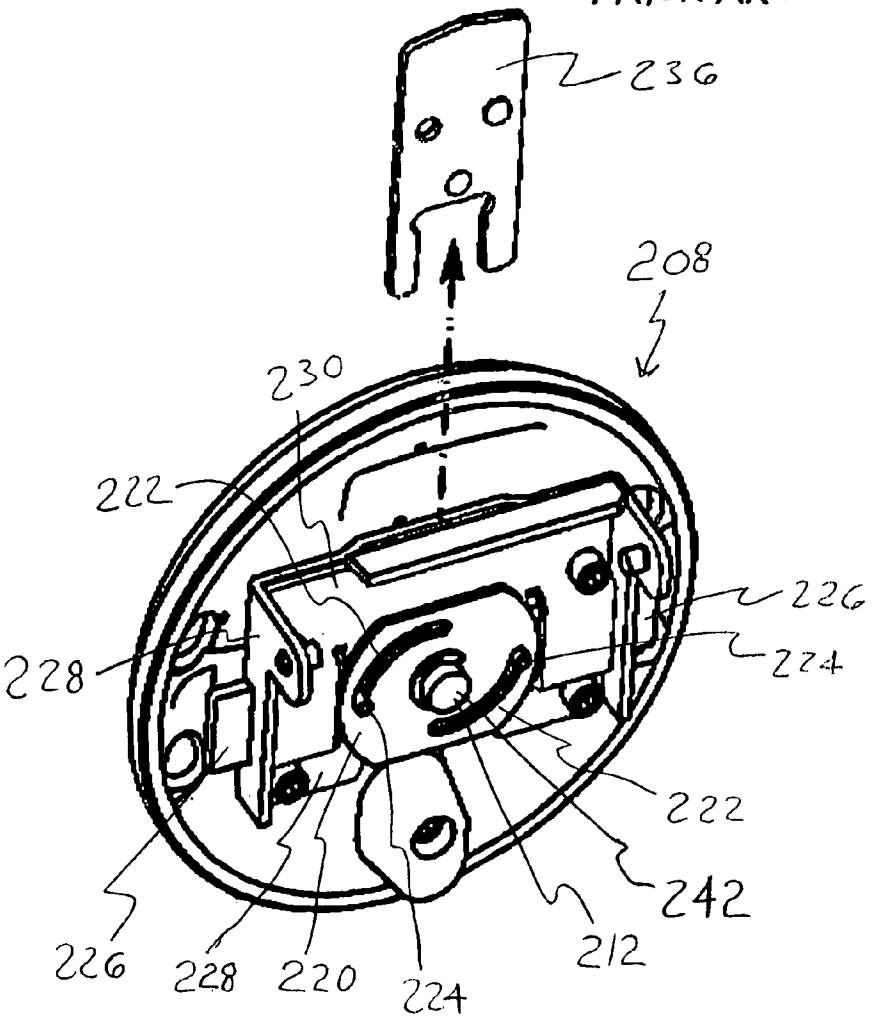
FIG. 2 PRIOR ART
FIG. 2 is an isometric view of a back side of a vault door showing the placement of a retainer for the known parking meter.
Figure 1:
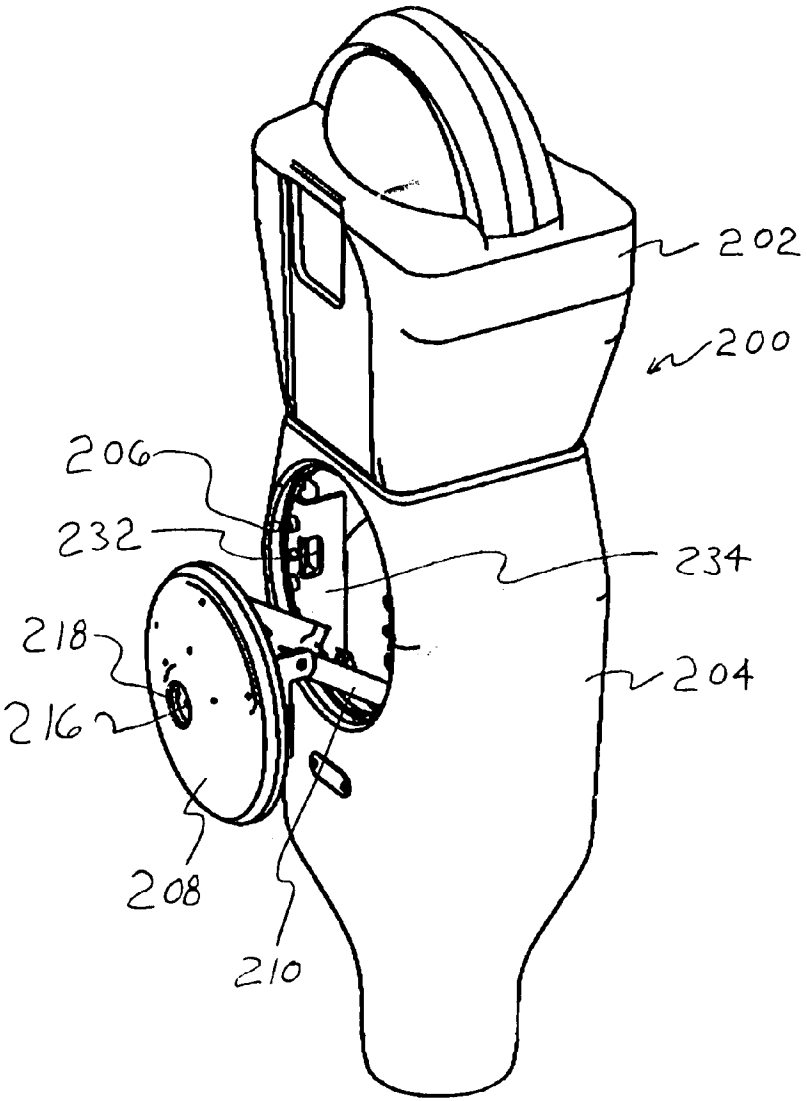
FIG. 1 PRIOR ART
FIG. 1 is a front and side isometric view of a parking meter as known in the prior art.
Figure 4:
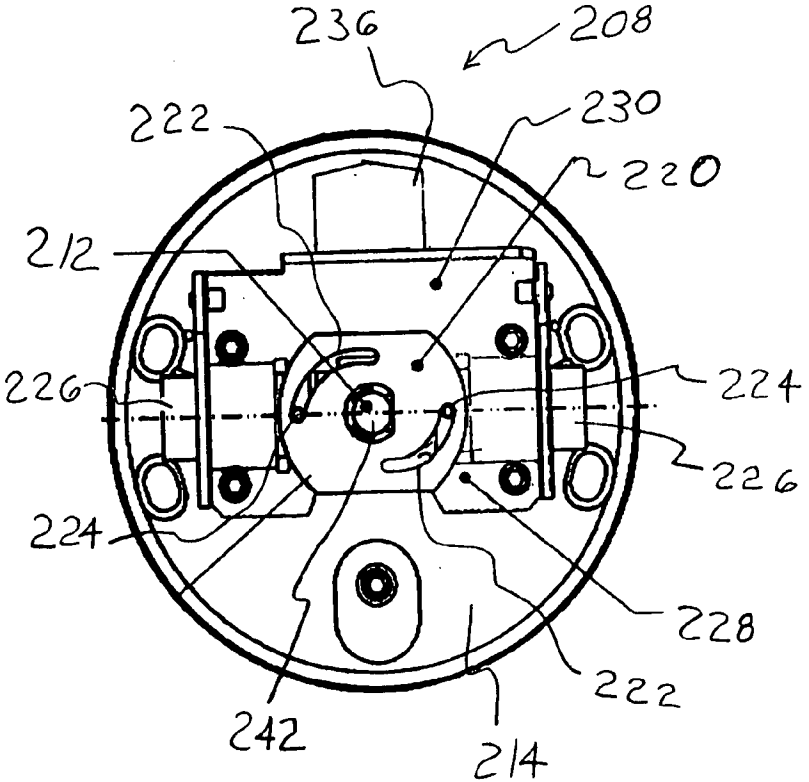
FIG. 4 PRIOR ART
FIG. 4 is an elevation of the back side of the vault door as known in the prior art.
Figure 3:
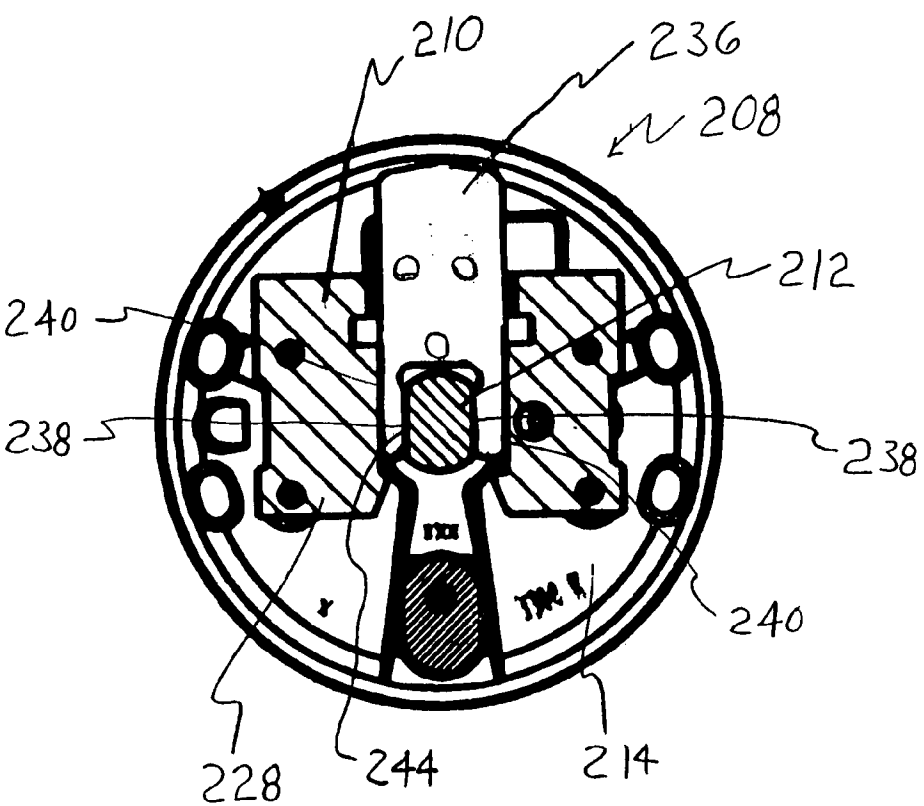
FIG. 3 PRIOR ART
FIG. 3 is an elevation of the back side of the vault door and a cross section through a lock assembly on the vault door as known in the prior art.
Figure 6:
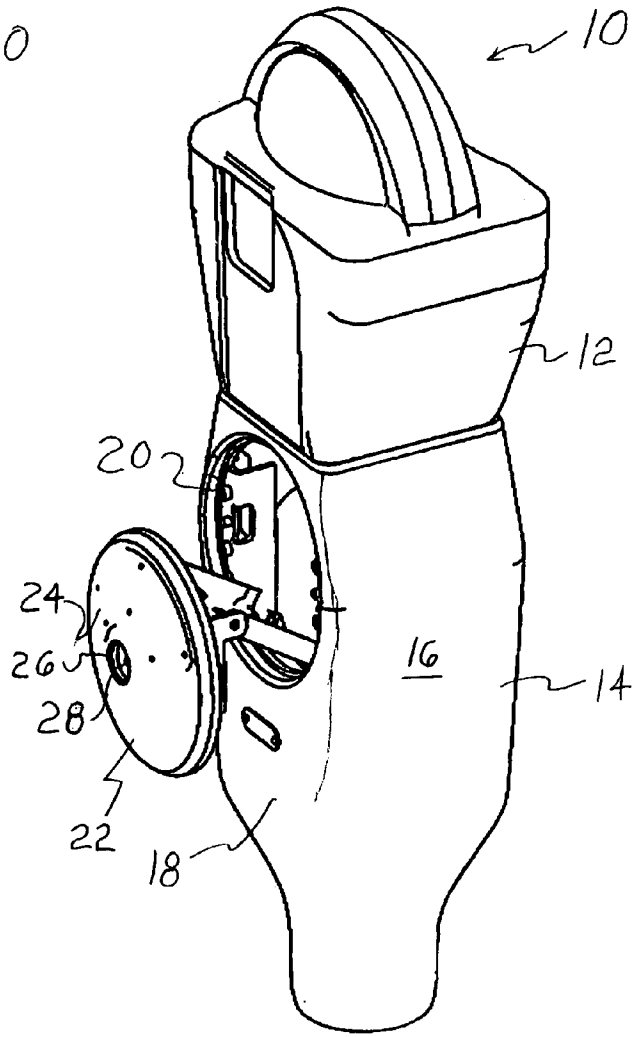
FIG. 6 is front and side isometric view of a parking meter with its vault door open according to the present invention.
Figure 5:
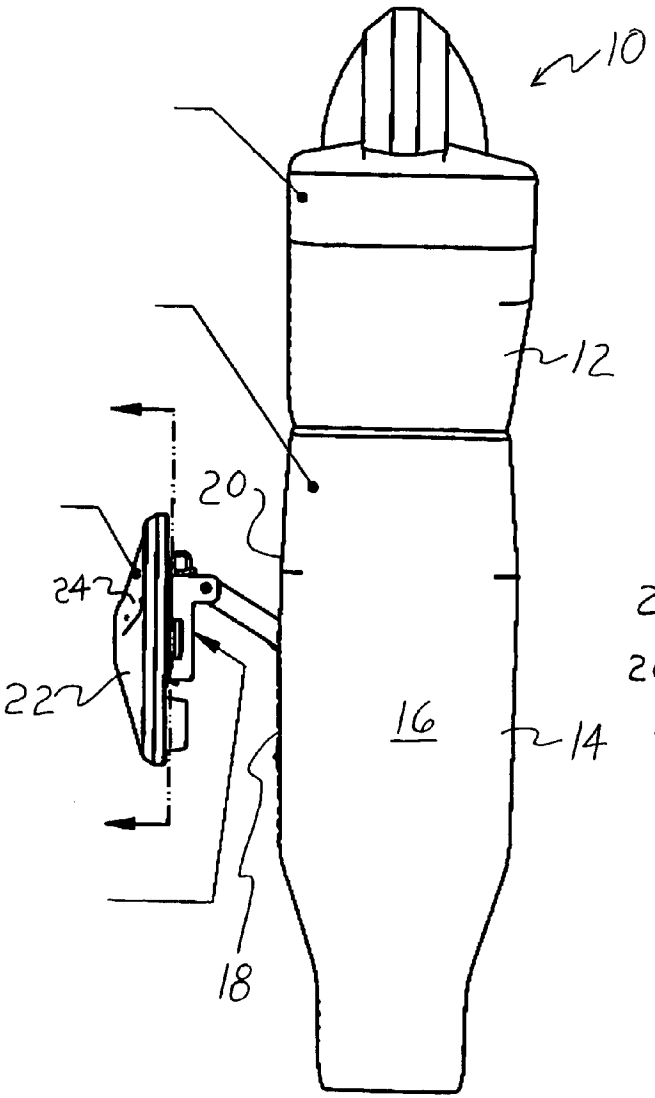
FIG. 5 is a side view elevation of a parking meter according to the present invention.
Figure 8:
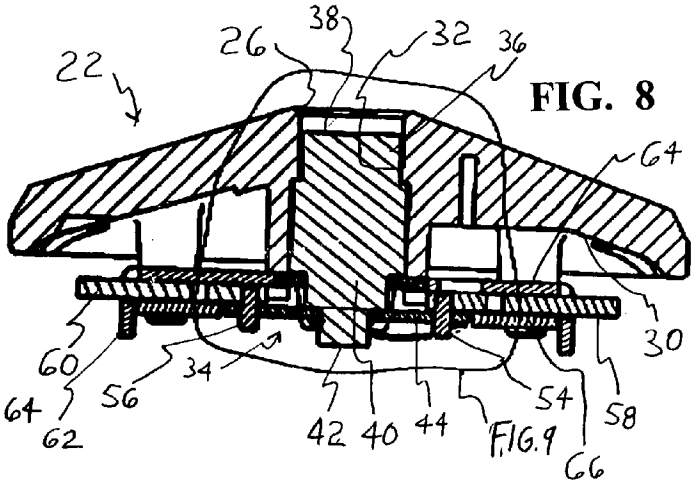
FIG. 8 is a top view cross section through the vault door as taken substantially along line 8—8 on FIG. 7.

Referring to FIGS. 5–6, a parking meter 10 has a collection and timer housing 12 positioned above a separate tamper-resistant enclosure or vault 14 that has a vault housing 16. The vault housing 16 has a front wall 18 that defines a doorway or main opening 20. A vault door 22 removably covers the main opening 20 for opening and closing the vault, and the front or exterior side 24 of the door 22 has an aperture 26 for providing exterior key access to a key hole 28. A coin box (not shown) is placed in, and taken out of, the interior of the vault housing 16 through main opening 20.

Referring to FIGS. 7–11, the vault door 22 has a back or interior side 30 facing the interior of the vault 14. The door 22 also provides a chamber 32 communicating with aperture 26 and the exterior 11. A of the vault as shown in FIGS. 8–11. A lock assembly 34 disposed on the back 30 of the door 22 has a lock cylinder 36 disposed in the chamber 32. The lock cylinder 32 can be any similar lock to that described here, such as Duncan DE Lock, Lori Lock, Illinois Lock, Abloy Lock, Kaba Lock, and Medeco Lock to name a few examples.

The lock cylinder 36 has a keyhole end 38 defining a key hole 26, an exterior surface or body 40 that loosely fits within chamber 30 and is usually stationary as described herein, and a movable portion or rotatable shaft (locking end) 42 preferably extending out of chamber 32 on the back 30 of the door 22, to operatively attach to a bolting mechanism. A lock cam 44 made of a flat plate is secured to the shaft 42 through a hole 48 formed at the center of the cam for this purpose. An E-clip 46 fastens the cam 44 to the shaft 42.

The lock cam 44 is attached to the bolting mechanism by two opposing, generally circumferentially extending slots 50, 52 (best seen in FIG. 7) that respectively receive bolt pins 54, 56 respectively extending from bolts 58, 60. The bolt pins 54, 56 are free to slide within the slots 50, 52. The lock assembly 34 also has a support structure 62 made of a first, back bracket plate 64 (also referred to herein as simply a bracket or plate) directly connected to the back 30 of the door 22, and a second or front bracket 66. The bolts 58, 60 are secured between raised portions 68 of the front bracket 66 and the back bracket 64, but permit the bolts to slide back and forth horizontally. Two upper screws or bolts 70 secure the front bracket 64 to the back bracket 62 and to the back 30 of the door 22, and two lower screws or bolts 72 secure the lower end of the back bracket 64 to the door 22.

Figure 9:
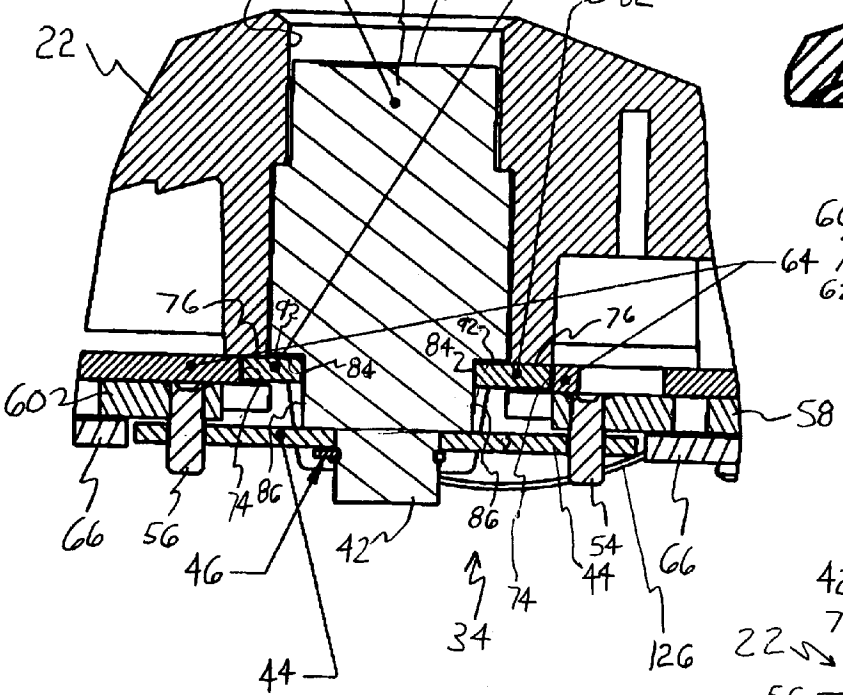
FIG. 9 is a close-up view of a portion of the cross section of FIG. 8.
Figure 11:
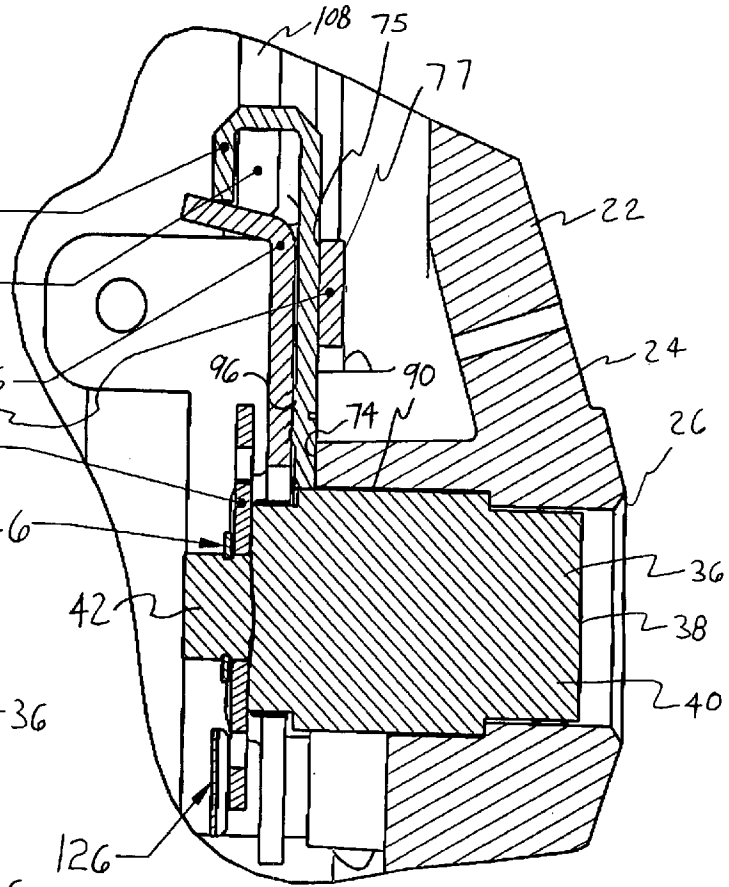
FIG. 11 is a close-up view of a portion of the cross section of FIG. 10.
Figure 10:
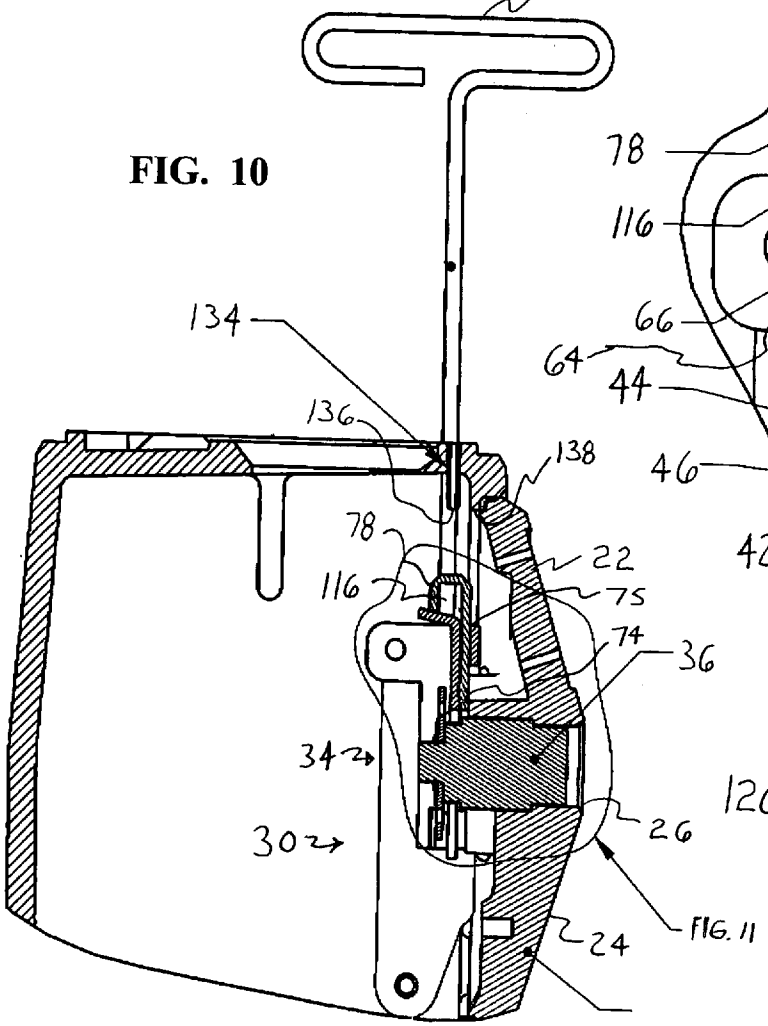
FIG. 10 is a side view cross section through the vault door and vault housing as taken along the line 10—10 on FIG. 12 and showing the placement of a disengagement tool according to the present invention.
Figure 12:
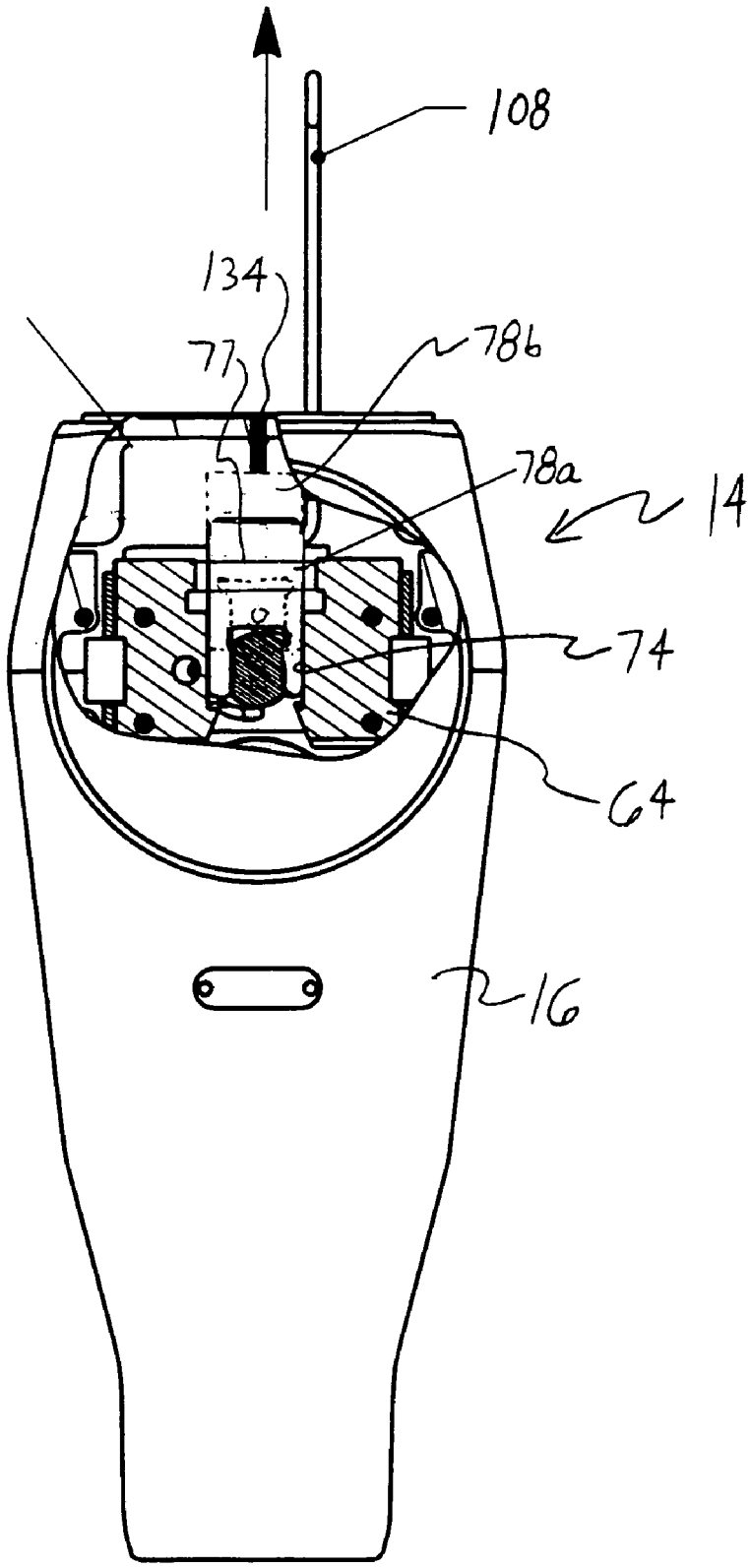
FIG. 12 is a front elevation of the parking meter partially cut away to show a cross section of a lock assembly on the back side of the vault door according to the present invention.

As shown in FIG. 12, this configuration forms a lower slot or opening 74 near the middle of the back bracket 64 for receiving a lock cylinder retainer plate or retainer 78. As shown in FIG. 9, slot 74 is behind cam 44 and is partially defined by a surface 76 of the back 30 of the door 22 abutting the retainer 78. The retainer 78 straddles the lock cylinder body 40 of the lock cylinder 36. An upper slot 75 is formed between a recessed portion 77 of the back bracket 64 (shown in see-through on FIG. 12) and the front bracket 66 (best seen in FIG. 11).

Referring to FIGS. 9–14, the retainer 78 is preferably formed from a generally flat cold rolled steel plate 79 with downwardly extending spaced legs 80, 82 with inner facing flats 84 that engage the sides or side walls 86 of the lock cylinder body 40 as shown in FIG. 9. The retainer 78 also has an upper flat 88 for engaging a top surface 90 of the lock cylinder body 40 as shown in FIG. 11. This provides a very snug fit on the lock cylinder 36 requiring a relatively forceful jerk or yank to pull the retainer 78 off of the lock cylinder body. This tight fit secures the lock cylinder both horizontally (x and y directions) and vertically (z direction) relative to the retainer. Slots 74 and 75 holding the retainer also provide a tight fit so that the retainer cannot rotate, twist or lean. The retainer legs 80, 82 also abut a shoulder 92 of the lock cylinder 36, which is flush with surface 76 of the back 30 of the door 22. This serves to trap and maintain the lock cylinder 36 against the back 30 of the door 22.

The front of the retainer 40 has a hole 94 used for prying the retainer out of the support structure 62 when the door 22 is already open, and two raised portions or dimples 96 that engages the front bracket 66 to provide a tight friction or interference fit within slots 74 and 75 between the bracket 66 in front of the retainer and the bracket 64 and the surface 76 behind the retainer (as best seen in FIG. 11).

Referring to FIGS. 13–14, the retainer 78 also has an extension 98 normal to the plane generally defined by the plate 79. The extension also has a lip 100 extending downwardly from the extension 98 and generally parallel to the plate 79. In cross section, and at sides 102, 104, the retainer 78 generally forms an inverted J-shape and defines an inverted pocket 106 for receiving and engaging a disengagement tool 108 (shown in FIGS. 15–16). The sides 102, 104 define a plane (a "side plane" P) that the disengagement tool 108 passes through in order to rest within the pocket 106. This configuration allows the tool 108 to engage the retainer 78 with a simple sideways movement of the tool (i.e. parallel to the front wall of the vault) in order to avoid any structure that could entangle with, or hamper the movement of, the tool 108.

While the preferred configuration uses the inverted J-shape, many other configurations for the retainer also fall within the scope of the invention. For example, as shown in dashed line on FIGS. 7, 13–14, the retainer 78 can be extended upward, and an aperture 110 can be provided that is clear and above the support structure 62 on the back 30 of the vault door 22. However, the extension and hole 110 must be small enough to provide enough vertical clearance for the retainer 78 to disengage from the lock cylinder 36. Although it is more difficult to avoid other structure within the vault housing 16 with this structure (since the retainer is up against the brackets 64, 66), the tool 108 still can be used to hook into aperture 110 to remove the retainer 78. It will be appreciated that the hole can be placed anywhere on the plate 79, and need not be centered and enlarged in an extension, as long as the hole 110 avoids the structure of the lock assembly 34 and enough clearance is provided to engage the tool 108 and raise the retainer 78 to disengage it from the lock cylinder 36. Many other structures for the retainer 78 are possible as long as it has a portion configured to engage the disengagement tool while the vault door 22 is closed and locked while permitting the retainer to disengage.

Referring to FIGS. 10, 15–16 and 19, the disengagement tool 108 has a handle 112 connected to the end of a shaft or rod 114 and ending in a hook 116. In the illustrated embodiment, the hook 116 has two generally linear sections 118, 120 for passing through plane P and entering pocket 106 to engage the retainer 78. The entire disengagement tool 108 is preferably made from a continuous bent length of steel or other metals.

Figure 19:
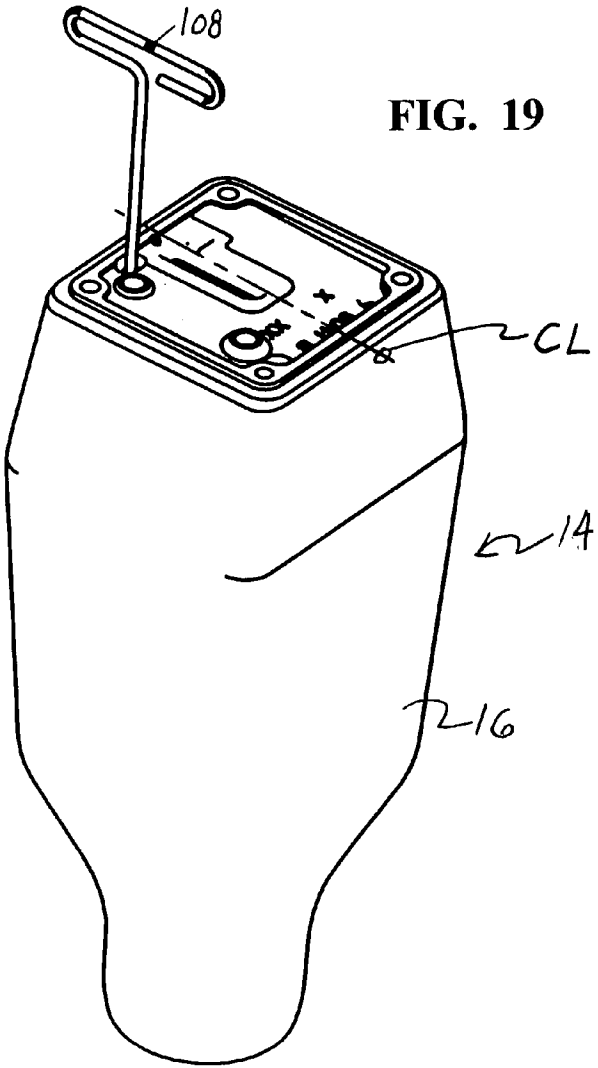
FIG. 19 is a back and side isometric view of a partially cut away parking meter vault showing the lock assembly on the back side of the vault door according to the present invention.

A top wall 122 of the vault housing 16 has a tool hole or slot 124 for receiving the disengagement tool and permitting access to the interior of the vault to engage the retainer 78 therein. Referring to FIGS. 6 and 19, it will be evident that the upper collection and timer housing 12 must first be removed or separated from the vault 14 in order to uncover and gain access to the tool hole 124.

Figure 7:
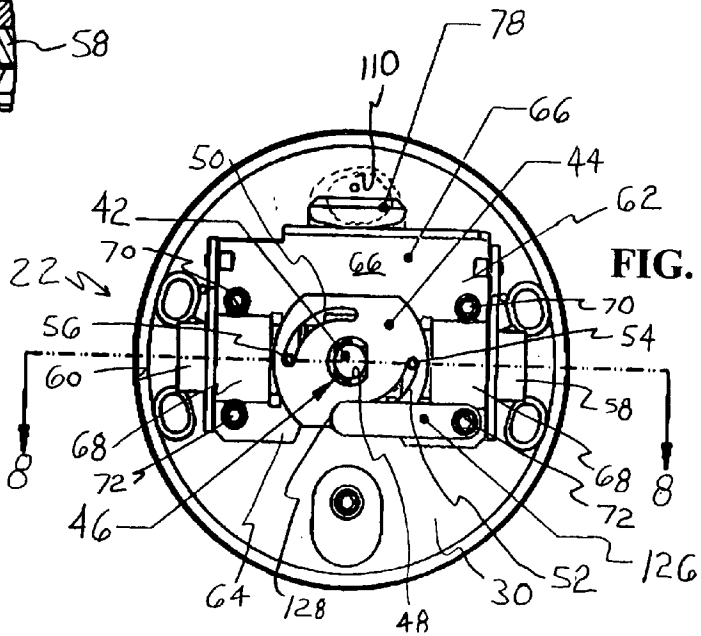
FIG. 7 is an elevation of the back side of a vault door according to the present invention.

Referring to FIGS. 7 and 17–18, the lock assembly 34 also has a spring clip 126 secured at one end to one of the lower bolts 72 and a free end 128 abutting lock cam 44. The free end 128 applies just enough pressure to hold the cam 44 and lock cylinder 36 against the back 30 of the door 22 and prevents the cam 44 from disengaging from bolt pins 54, 56. The pressure from the clip 126 against the cam 44, however, is light enough to permit the cam to rotate and slide against the clip 126. Complete disengagement of the retainer 78 from the lock cylinder body 40 is then possible without the cam 44 and lock cylinder 36 falling into the interior of the vault housing 14.

As shown in FIGS. 17–18, the spring clip 126 in the illustrated embodiment is preferably a flat plate 128 made of blued spring steel or other metal with a hole 130 on the fixed end. The plate 128 is bent to bias the clip 126 against the cam 44 once the clip is disposed on the lock assembly 34.

Figure 20:
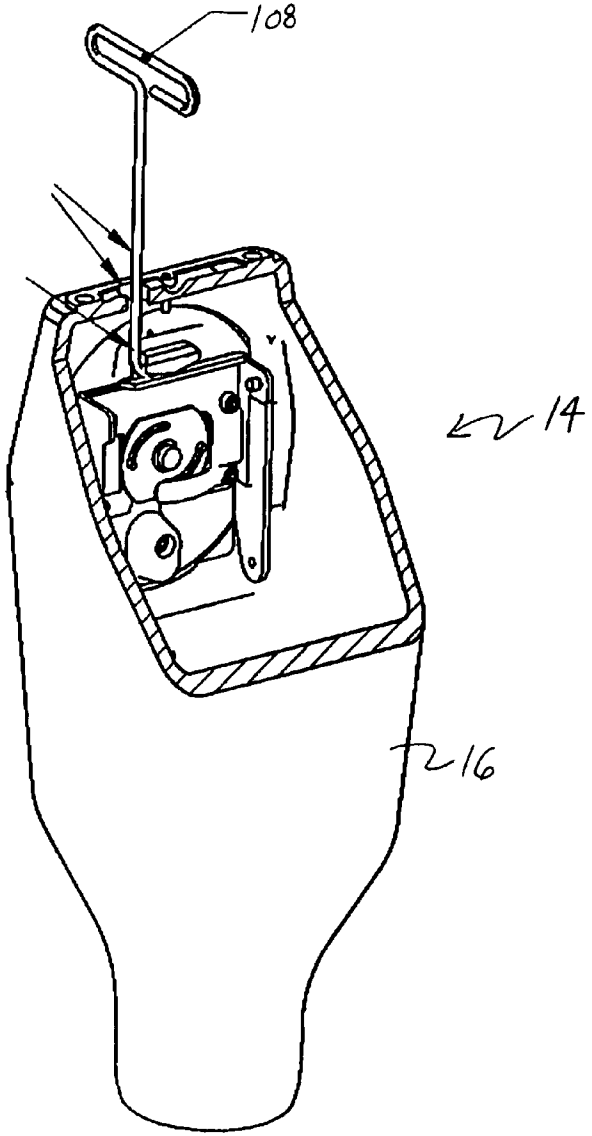
FIG. 20 is a back side isometric view of the vault door and showing the position and motion of the disengagement tool with the retainer in relation to the lock assembly on the vault door according to the present invention.

Referring to FIGS. 12 and 19–23, in order to unlock and open the vault door 22 when the lock cylinder is jammed, as mentioned previously, the collection and timer housing 12 must be separated from the vault 14 to uncover the tool hole 124. Once the tool hole 124 is exposed, the disengagement tool 108 is inserted into the tool hole. The tool hole 124 is preferably located on the top wall 122 of the vault housing 16 so that the tool 108 need only be lowered straight down to the vicinity of the retainer 78 while maintaining the hook 116 of the tool 108 generally parallel to the front wall 18 of the housing 16 and pointing toward the center line (CL) (shown in FIG. 19) of the housing where the retainer 78 is located. Then the tool 108 need only be adjusted slightly sideways and toward centerline CL so that it passes through plane P of the retainer 78 and enters the inverted pocket 106 to engage the retainer 78 as shown in FIG. 20.

Figures 21, 22, 23:
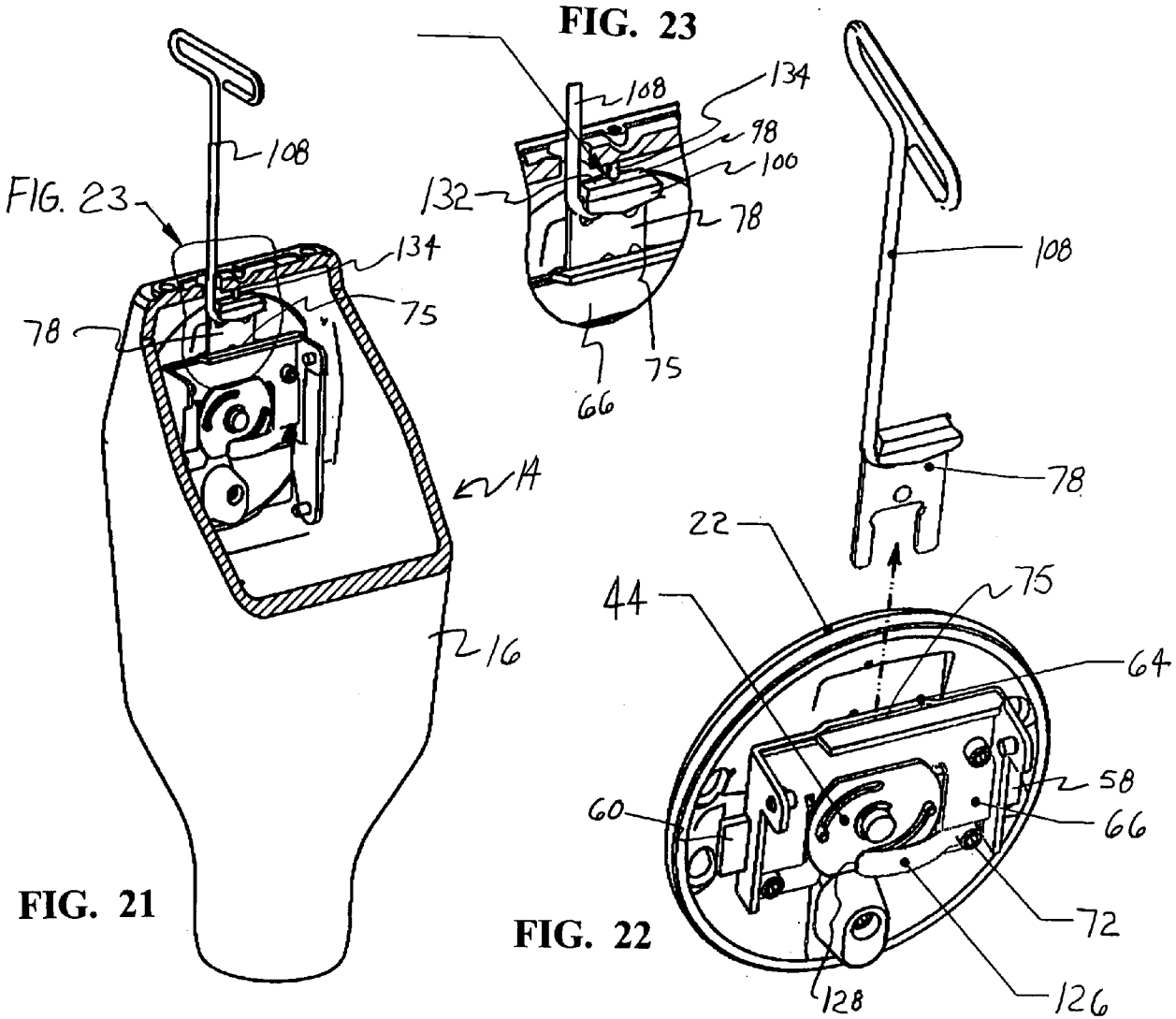
FIG. 21 is a close-up view of the retainer, disengagement tool and stopper on FIG. 19 according to the present invention.
FIG. 22 is side and back isometric view of the parking meter vault with the disengagement tool according to the present invention.
FIG. 23 is a side and back isometric view of the parking meter partially cut away to show the lock assembly and initial engagement of the disengagement tool with the retainer according to the present invention.

As shown in FIGS. 12 and 23, retracting the disengagement tool from the tool hole 124 pulls the retainer 78 upward and away from the lock cylinder 36. Due to the tight fit between the lock cylinder body 40 and the retainer 78, a hard or forceful upward pull or jerk of the tool 108 may be necessary to disengage the retainer 78 from an engaged position 78*a* (on FIG. 12) to a disengaged position 78*b* (on FIG. 12).

Referring to FIGS. 10, 12, 21 and 23, as the retainer 78 is pulled away from the lock cylinder 36 and through the support structure 62, the top surface 132 of the retainer 78 engages a stopper 134 extending from the top wall 122 of the vault housing 16 (shown best in FIG. 23). The stopper 134 is positioned to prevent over extension of the retainer 78 to where it will interfere with the opening of the vault door 22 by engaging the front wall 18 of the housing 16, and block further opening of the vault door. As shown best in FIG. 10, the distal end 136 of the stopper 134 should be the same height or lower than the height of the top edge 138 of the main opening 20. In the illustrated embodiment, the stopper is a cylindrical pin welded through a hole onto the top wall 122 of the housing 16, and is preferably made of steel.

Once the retainer 78 abuts the stopper 134, an instrument (not shown) such as a screw driver can be inserted into the key hole 28 of the lock cylinder 36 and turned or rotated to rotate the lock cylinder body 40. Since the lock cylinder 40 is jammed, its shaft 42 will also rotate with the rotation of the lock cylinder body 40. The rotation of the shaft 42 will rotate the cam 44, and in turn slide the bolts 58, 60 to unlock the door 22.

Once the door 22 is unlocked, it can be swung open slightly to ensure that it does not reclose while the disengagement tool 108 is being removed from the retainer 78, which prevents any further opening of the door 22. As long as the door 22 is ajar, it does not matter if the retainer slides back down in the support structure 62 after the tool 108 is released from the retainer 78. At this point, the vault door 22 can be fully open and the disengagement tool 108 can be removed from the tool hole 124. Since no other work is done to the door 22 to unlock the jammed lock, no damage to any other part of the door 22 and lock assembly 34 occurs, saving much expense.

It will be appreciated that full disengagement of the retainer 78 from the lock cylinder body 40 is not necessary as long as enough disengagement occurs to permit the lock cylinder body (or usually stationary portion) 40 to be rotated.

It will also be appreciated that the top wall can be provided with other holes to see into the vault housing 16 so that the engagement of the disengagement tool on the retainer can be accomplished by eye rather than just merely feel. However, this is not preferred since it may provide a means of access or a view of the lock assembly 34 to persons not authorized to open the vault 14.

The advantages of the present parking meter 10 and vault 14 are now apparent. The parking meter vault 14 has a retainer 78 with a portion configured for engaging a disengagement tool 108 so that the retainer 78 can be disengaged from a lock cylinder 36 on the back 30 of a vault door 22 even though the vault door is closed and locked. A spring clip 126 prevents the lock cylinder 36 from falling into the vault interior once the retainer 78 is disengaged. A stopper 134 prevents over extension of the retainer 78 where it can block the opening of the vault door 22.

While the present invention has been described in conjunction with a parking meter vault, it has application to any similar enclosure which is designed to be located in a public place and which therefore is subject to unauthorized attempts to open it. Such enclosures include coin boxes for pay telephones and vending machines, pad-mounted transformers, telephone distribution boxes, ATMs and similar enclosures protecting property otherwise amenable to theft or tampering.

Therefore, any locked enclosure with a retainer holding a lock cylinder may fall within the scope of the invention.

While various embodiments of the present invention have been described, it should be understood that other modifications and alternatives can be made without departing from the spirit and scope of the invention, which should be determined from the appended claims.

I claim:

1. A parking meter, comprising:

a vault housing having a wall defining a main opening providing access to an interior of said housing from an exterior of said housing;

a vault door removably covering said main opening and having a back facing said interior of said housing; and a lock assembly including:

a lock cylinder disposed on said door and having a usually stationary body and a usually movable portion designed to move relative to said body, a bolting mechanism operatively connected to said movable portion of said lock cylinder for selectively providing a locked position, a support structure disposed on said back of said door and holding said bolting mechanism on said back of said door; and a removable retainer engaging said body of said lock cylinder for preventing motion of said body that interferes with operation of said movable portion, said retainer thereby preventing sufficient motion of said body to operate said bolting mechanism when said movable portion is not moving relative to said body, said support structure configured for releasably maintaining said retainer on said body and preventing motion of said retainer in a direction other than a direction defined by release of said retainer, said vault housing defining a tool hole providing access to said interior of said housing for insertion of a disengagement tool through said tool hole, said retainer having a portion configured for connecting to said disengagement tool, said retainer being configured so that retracting said disengagement tool as connected to said retainer, when said movable portion will not move relative to said body, provides enough disengagement from said body to permit motion of said body to operate said bolting mechanism.

2. The parking meter according to claim 1, wherein said retainer has an extension configured for engaging a hook on said tool.

3. The parking meter according to claim 2, wherein said retainer is a generally flat plate defining a plane, and wherein said extension extends generally normal to said plane.

4. The parking meter according to claim 3, wherein said extension has a lip extending generally parallel to said plane, wherein said plane, said extension and said lip cooperatively generally form an inverted J-shape in cross section.

5. The parking meter according to claim 2, wherein said retainer has at least one elongated side, and wherein said extension has a lip disposed so that said retainer generally forms an inverted J-shape in cross section and defines an inverted pocket, said elongated side forming said inverted J-shape defining a side plane, said retainer being configured and disposed so that said disengagement tool engages said retainer within said inverted pocket by passing through said side plane.

6. The parking meter according to claim 2, wherein said extension of said retainer defines an aperture that is disposed in an area clear of said support structure for receiving said hook of said disengagement tool.

7. The parking meter according to claim 1, further comprising a coin slot and timer housing disposed above said vault and covering said tool hole, wherein said coin slot and timer housing is configured so that it must be separated from said vault in order to gain access to said tool hole on said vault.

8. The parking meter according to claim 1, wherein said vault housing includes a stopper extending from a wall of said housing and toward a vicinity of said retainer, said stopper being configured to engage and stop said retainer as said disengagement tool moves said retainer away from said lock cylinder to prevent over extension of said retainer.

9. The parking meter of claim 1, wherein said retainer is further configured and disposed for maintaining said lock cylinder on said door, and wherein said movable portion of said lock cylinder is a rotatable shaft extending from said lock cylinder body, said lock cylinder including a lock cam disposed on said shaft for rotating when said shaft is rotated, said lock cam being operably attached to said bolting mechanism to move said bolting mechanism upon rotation of said cam, and wherein said lock assembly includes a clip secured to said support structure and abutting said cam, wherein said clip retains said cam and said lock cylinder on said back of said door when said retainer is disengaged from said lock cylinder permitting said lock cylinder to move.

10. The parking meter according to claim 9, wherein said door defines a chamber for receiving said lock cylinder, said lock cylinder having a shoulder facing away from said chamber and toward said interior of said vault, and wherein said retainer engages said shoulder for retaining said lock cylinder within said chamber.

11. The parking meter according to claim 1, wherein said vault door defines a key hole providing key access to said lock cylinder from said exterior, said tool being configured for disengaging said retainer from said lock cylinder body so that said lock cylinder body is free to rotate upon urging from an instrument inserted through said key hole.

12. A parking meter vault, comprising:

a parking meter vault housing having a front wall defining a main opening providing access to an interior of said housing from an exterior of said housing;

a parking meter vault door removably covering said main opening and having a back facing said interior of said housing; and a lock assembly having a usually stationary portion and a usually movable portion for locking and unlocking said door, said lock assembly being disposed on said back of said door and being operatively accessible from said exterior;

a retainer for preventing motion of said stationary portion of said lock assembly that would unlock said door or render said lock inoperable; and a means for moving said retainer while said vault door is closed and locked for permitting motion of said stationary portion of said lock assembly to unlock said door without damaging said door or said lock assembly.

13. The parking meter vault according to claim 12, wherein said means for moving includes said vault housing defining a tool hole for permitting a disengagement tool to enter said interior of said vault and engage said retainer, wherein retracting said tool moves said retainer.

14. The parking meter vault of claim 12, wherein said means for moving permits said stationary portion to be rotated by inserting an instrument through an aperture on said door provided for said operative access of said lock assembly means, and urging rotation of said stationary portion by rotating said instrument, whereby such rotation unlocks said door.

15. A parking meter vault, comprising:

a vault housing having a front wall defining a main opening providing access to an interior of said housing from an exterior of said housing;

a vault door removably covering said main opening and having a back facing said interior of said housing; and a lock assembly including:

a lock cylinder disposed on said door and having a usually stationary body and a usually movable portion designed to move relative to said body, a bolting mechanism operatively connected to said movable portion of said lock cylinder for selectively providing a locked position, a support structure disposed on said back of said door and holding said bolting mechanism on said back of said door; and a removable retainer engaging said body of said lock cylinder for preventing motion of said body that interferes with operation of said movable portion and for preventing sufficient motion of said body to operate said bolting mechanism when said movable portion is not moving relative to said body, said support structure configured for releasably maintaining said retainer on said body and preventing motion of said retainer in a direction other than a direction defined by release of said retainer, said vault housing defining a tool hole providing access to said interior of said housing for insertion of a disengagement tool through said tool hole, said retainer having a portion configured for connecting to said disengagement tool, said retainer being configured so that retracting said disengagement tool connected to said retainer, when said movable portion will not move relative to said body, provides enough disengagement from said body to permit motion of said body to operate said bolting mechanism.

16. The vault according to claim 15, wherein said retainer has an extension configured for engaging a hook on said tool.

17. The vault according to claim 16, wherein said retainer is a generally flat plate defining a plane, and wherein said extension extends generally nomnal to said plane.

18. The vault according to claim 17, wherein said extension has a lip extending generally parallel to said plane, wherein said plane, said extension and said lip cooperatively generally form an inverted J-shape in cross section.

19. The vault according to claim 16, wherein said retainer has at least one elongated side, and wherein said extension has a lip disposed so that said retainer generally forms an inverted J-shape in cross section and defines an inverted pocket, said elongated side forming said inverted J-shape and defining a side plane, said retainer being configured and disposed so that said disengagement tool engages said retainer within said inverted pocket by passing through said side plane.

20. The vault according to claim 16, wherein said extension of said retainer defines an aperture that is disposed in an area clear of said support structure for receiving said hook of said disengagement tool.

21. The vault according to claim 15, wherein said vault housing includes a stopper extending from a wall of said housing and toward a vicinity of said retainer, said stopper being configured to engage and stop said retainer as said disengagement tool moves said retainer away from said lock cylinder to prevent over extension of said retainer.

22. The vault according to claim 15, wherein said retainer is further configured and disposed for maintaining said lock cylinder on said door, and wherein said movable portion of said lock cylinder is a rotatable shaft extending from said lock cylinder body, said lock assembly having a lock cam disposed on said shaft for rotating when said shaft is rotated, said lock cam being operatively attached to said bolting mechanism to move said bolting mechanism upon rotation of said cam, and wherein said lock assembly includes a clip secured to said support structure and abutting said cam, wherein said clip retains said cam and said lock cylinder on said back of said door when said retainer is disengaged from said lock cylinder permitting said lock cylinder to move.

23. The parking meter according to claim 22, wherein said door defines a chamber for receiving said lock cylinder, said lock cylinder having a shoulder facing away from said chamber and toward said interior of said vault, and wherein said retainer engages said shoulder for retaining said lock cylinder within said chamber.

24. The parking meter according to claim 15, wherein said vault door defines a key hole providing key access to said lock cylinder from said exterior, said disengagement tool being configured for disengaging said retainer from said lock cylinder body so that said lock cylinder body is free to rotate upon urging from an instrument inserted through said key hole.

25. A quick lock release system for a parking meter, comprising:

a parking meter vault having a housing with a front wall defining a main opening and a vault door removably covering said opening, said door having a back and a lock assembly disposed on said back, said lock assembly having a lock cylinder having a body and a usually movable portion extending from said body and being movable relative to said body, a support structure, and a retainer engaging said lock cylinder body to prevent movement of said lock cylinder body relative to said support structure and said door, said support structure preventing movement of said retainer while said retainer is engaged with said lock cylinder body, said housing having a tool hole; and a disengagement tool being configured for insertion through said tool hole and into said housing, said tool having an end configured for engaging said retainer to disengage said retainer from said lock cylinder body by retracting said tool, said retraction permitting said lock cylinder body to be moved to unlock said door when said movable portion will not move relative to said body.

26. The system according to claim 25, wherein said retainer has an extension configured for engaging a hook on said tool.

27. The parking meter according to claim 26, wherein said retainer is a generally flat plate defining a plane, and wherein said extension extends generally normal to said plane.

28. The parking meter according to claim 27, wherein said extension has a lip extending generally parallel to said plane, said plane, said extension and said lip cooperatively generally forming an inverted J-shape in cross section.

29. The parking meter according to claim 26, wherein said retainer has at least one elongated side, and wherein said extension has a lip disposed so that said retainer generally forms an inverted J-shape in cross section and defines an inverted pocket, said side forming said inverted J-shape and defining a side plane, said retainer being configured and disposed so that said disengagement tool engages said retainer within said inverted pocket by passing through said side plane.

30. The parking meter according to claim 26, wherein said extension of said retainer defines an aperture that is disposed in an area clear of said support structure for receiving said hook of said disengagement tool.

31. The parking meter according to claim 25, further comprising a coin slot and timer housing disposed adjacent said vault and covering said tool hole, wherein said coin slot and timer housing is configured so that it must be separated from said vault in order to gain access to said tool hole on said vault.

32. The parking meter according to claim 25, wherein said vault housing includes a stopper extending from a wall of said housing and toward a vicinity of said retainer, said stopper being configured to engage and stop said retainer as said disengagement tool moves said retainer away from said lock cylinder to prevent over extension of said retainer.

33. The parking meter of claim 25, wherein said retainer is further configured and disposed for maintaining said lock cylinder on said door, and wherein said movable portion of said lock cylinder is a rotatable shaft extending from said lock cylinder, said lock assembly having a lock cam disposed on said shaft for rotating when said shaft is rotated, said lock cam being operatively attached to said bolting mechanism to move said bolting mechanism upon rotation of said cam, and wherein said lock assembly includes a clip secured to said support structure and abutting said cam, wherein said clip retains said cam and said lock cylinder on said back of said door when said retainer is disengaged from said lock cylinder permitting said lock cylinder body to move.

34. The parking meter according to claim 33, wherein said door defines a chamber for receiving said lock cylinder, said lock cylinder having a shoulder facing away from said chamber and toward said interior of said vault, and wherein said retainer engages said shoulder for retaining said lock cylinder within said chamber.

35. The parking meter according to claim 25, wherein said vault door defines a key hole providing key access to said lock cylinder from said exterior, said tool being configured for disengaging said retainer from said lock cylinder body so that said lock cylinder body is free to rotate upon urging from an instrument inserted through said key hole.

36. A lock cylinder retainer for a lock assembly with a lock cylinder having a body, a support structure and a bolting mechanism on a parking meter vault door of a vault with a tool hole, comprising:

a retainer body including:

a first end configured for engaging the lock cylinder for preventing movement of the lock cylinder body relative to the support structure and the door, sides for engaging said support structure to prevent movement of said retainer, and, an upper end configured for engaging a disengagement tool configured for entering said vault through the tool hole while said vault door is closed and locked, wherein retracting said disengagement tool once engaged with said retainer disengages said retainer from said lock cylinder body to permit said lock cylinder body to move to unlock said vault door.

37. The retainer according to claim 36, comprising an extension configured for engaging a hook on said tool.

38. The retainer according to claim 37, wherein said retainer is a generally flat plate defining a plane, and wherein said extension extends generally normal to said plane.

39. The retainer according to claim 38, wherein said extension has a lip extending generally parallel to said plane, said plane, said extension and said lip cooperatively generally forming an inverted J-shape in cross section.

40. The retainer according to claim 37, wherein said extension has a lip disposed so that said retainer generally forms an inverted J-shape in cross section and defines an inverted pocket, at least one said side also forming said inverted J-shape and defining a side plane, said retainer being configured and disposed so that said disengagement tool engages said retainer within said inverted pocket by passing through said side plane.

41. The retainer according to claim 37, wherein said extension of said retainer defines an aperture that is disposed in an area clear of said support structure for receiving said hook of said disengagement tool.

42. A tamper-resistant locked enclosure, comprising:

a wall defining a main opening to the enclosure and separating an exterior of the enclosure from an interior of the enclosure;

an enclosure door removably covering the main opening and having a back facing the interior of the enclosure;

a lock assembly mounted on the door and having a first, usually stationary portion and a second portion movable relative to the first portion, preselected movement of the second portion causing the door to be unlocked from the opening, the preselected movement actuated by a key applied to the lock assembly from said exterior, preselected movement of the first portion also causing the door to be unlocked from the opening;

a retainer movable between first and second positions, the retainer in the first position engaging the first portion of the lock assembly to prevent the preselected movement of the first portion, the retainer in the second portion permitting the preselected movement of the first portion of the lock assembly, the retainer further having a disengagement tool connection portion;

the enclosure further defining a tool hole communicating the exterior to the interior; and a disengagement tool having an end for insertion into the tool hole and connecting to the disengagement tool portion of the retainer, the disengagement tool actuable to move the retainer to the second position so as to permit the first portion of the lock assembly to be moved, thereby opening the door.

43. The enclosure of claim 42, wherein the lock assembly includes a lock cylinder, said first portion being an exterior surface of the lock cylinder.

44. A tamper resistant locked parking meter vault, comprising:

means for disengaging a retainer engaged on a lock cylinder body disposed on a back of a parking meter vault door of the parking meter vault while said door is closed and locked on said vault, said back facing the interior of the vault; and means for moving said lock cylinder body for unlocking said door when the retainer is disengaged, said disengaging being performed without damaging said door and said vault.

45. A method of unlocking a closed and locked parking meter vault, comprising the steps of:

disengaging a retainer engaged on a lock cylinder body disposed on a back of a parking meter vault door of the parking meter vault while said door is closed and locked on said vault, said back facing the interior of the vault; and moving said lock cylinder body to unlock said door, said step of disengaging being performed without damaging said door and said vault.

46. The method of claim 45, further comprising the steps of:

inserting a disengagement tool through a tool hole defined on a housing of the vault and into an interior of the housing; and engaging said retainer with said disengagement tool; and wherein said step of disengaging includes retracting said disengagement tool to disengage said retainer from said lock cylinder body.

47. The method of claim 46, further including the steps of:

holding said retainer in a disengaged position;

inserting an instrument into a key hole formed on said door and providing key access to said lock cylinder, and engaging said lock cylinder with said instrument; and rotating said lock cylinder body by rotating said instrument, said lock cylinder being operatively connected to a bolting mechanism that unlocks said vault door upon rotation of said lock cylinder body.

48. The method of claim 47, further comprising the steps of:

preventing said lock cylinder from falling off of said back of said vault door including the steps of:

abutting a free end of a clip against a cam secured to said lock cylinder and operatively engaged with said bolting mechanism, said clip having a fixed secured to a support structure, wherein said clip retains said cam and said lock cylinder against said door when said cam disengages from said bolting mechanism.

49. The method of claim 47, wherein said housing has a wall defining a main opening selectively covered by said vault door, the method further comprising the step preventing said retainer from blocking the swinging open of said vault door, wherein said step of disengaging includes moving said retainer away from said lock cylinder until said retainer engages a stopper extending from said housing, said stopper stopping said retainer at a position that said retainer will not engage said wall of said housing as said door is swung open.

50. A tamper-resistant locked enclosure, comprising:

a wall of the enclosure separating an interior of the enclosure from an exterior thereof, the wall defining an opening from the exterior to the interior;

a door positioned over the opening, a keyed lock cylinder mounted through the door for locking the door to the opening of the lock cylinder affixed to the door by a removable retainer; and a spring clip joined to an interior surface of the door and applying pressure on the lock cylinder to bias the lock cylinder toward the exterior, such that when the retainer is removed the lock cylinder will not fall into the interior of the enclosure.

51. A parking meter vault, comprising:

a housing defining a doorway;

a door removably covering said doorway, said door having a back facing an interior of said housing;

a lock assembly disposed on said back of said door; and said housing defining a tool hole separate from said doorway for providing access to said interior of said vault for a disengagement tool for moving at least a portion of said lock assembly.

52. A parking meter, comprising:

a parking meter vault including:

a housing defining a doorway;

a door removably covering said doorway, said door having a back facing an interior of said housing;

a lock assembly disposed on said back of said door; and said housing defining a tool hole separate from said doorway for providing access to said interior of said vault for a disengagement tool for moving at least a portion of said lock assembly; and a parking meter operation part having a housing abutting said parking meter vault and covering said tool hole when said parking meter is in an assembled state.

* * * * *

UNITED STATES PATENT AND TRADEMARK OFFICE

CERTIFICATE OF CORRECTION

PATENT NO. : 6,874,340 B1
APPLICATION NO. : 10/159552
DATED : April 5, 2005
INVENTOR(S) : Lawrence Berman It is certified that error appears in the above-identified patent and that said Letters Patent is hereby corrected as shown below:

Col. 10, Line 54 -
claim 17, line 3
delete "extension extends generally nomnal to said plane." and insert therefor:
--extension extends generally normal to said plane.--

Signed and Sealed this

Thirteenth Day of March, 2007

JON W. DUDAS
*Director of the United States Patent and Trademark Office*